United States Patent [19]

Reibakh

[11] Patent Number: 4,617,764

[45] Date of Patent: Oct. 21, 1986

[54] NC VERTICAL SPINDLE JIG GRINDER

[75] Inventor: Judel S. Reibakh, Moscow, U.S.S.R.

[73] Assignee: Experimentalny Nauchno-Issledovatelsky Institut Metallorezhuschikh Stankov, Moscow, U.S.S.R.

[21] Appl. No.: 737,190

[22] Filed: May 23, 1985

[51] Int. Cl.[4] ..... B24B 53/14

[52] U.S. Cl. ..... 51/165.71; 51/5 D; 51/33 R; 51/166 T

[58] Field of Search ..... 51/5 D, 165.71, 165 TP, 51/33 R, 166 T

[56] References Cited

U.S. PATENT DOCUMENTS

| | | | |
|---|---|---|---|
| 1,662,137 | 3/1928 | Summers | 51/33 R |
| 3,030,739 | 4/1962 | Folley | 51/33 R |
| 3,680,263 | 8/1972 | Johnson | 51/96 |
| 4,186,529 | 2/1980 | Huffman | 51/165 TP |
| 4,274,231 | 6/1981 | Verega | 51/5 D |
| 4,461,121 | 7/1984 | Mortzer et al. | 51/3 |
| 4,524,543 | 6/1985 | Inoue | 51/165.92 |

*Primary Examiner*—Harold D. Whitehead
*Attorney, Agent, or Firm*—Ladas & Parry

[57] ABSTRACT

An NC vertical spindle jig grinder comprises a bed having a column with vertical ways and a compound table carrying the workpiece and a wheel dresser. The compound table is movable along the X and Y axes. A slide having a lay-shaft is traversable upon the vertical ways of the column along the Z axis. The slide has circular ways for supporting a cradle traversable along a circular coordinate axis B with respect to the axis of the lay-shaft. The cradle carries a turret indexable about its axis, the turret having at least two wheelheads provided with wheel spindles rotatable about the longitudinal axis of the wheelhead, the spindles spherical abrasive tools of different diameters. The grinder also comprises an NC system electrically connected to various movable assemblies of the grinder.

4 Claims, 2 Drawing Figures

NC VERTICAL SPINDLE JIG GRINDER

FIELD OF THE ART

The invention relates to the field of abrasive machining, and more specifically, it deals with NC vertical spindle jig grinders.

The invention may be used in machining three-dimensional surfaces in the mechanical engineering, e.g. in machining workpieces such as three-dimensional dies, moulds and templets.

BACKGROUND OF THE INVENTION

Nomenclature of parts having critical intricately shaped and precise surfaces continuously grows in modern mechanical engineering because of the rising speeds of machines and intensification of manufacturing processes. This results in a wider use of automatic machines employing three-dimensional cams, templets, dies, moulds, fashioned shafts, globoids and conoids. Since these parts function under high loads, their critical surfaces should preferably be heat treated with subsequent grinding and high-precision forming to ensure wear resistance.

Known in the art is an NC vertical spindle jig grinder (cf. USSR Inventor's Certificate No. 656813, Cl. B 24 B 17/10, 1979), comprising a bed, a compound table traversable on the hed along the X and Y axes, and a column rigidly held to the bed and carrying a wheel dresser and vertical ways supporting a wheelhead.

It should be noted that this prior art grinder is only designed for machining workpieces with their surfaces defined by planar curves. This grinder cannot be used for machining three-dimensional workpieces with double-curvature surfaces.

SUMMARY OF THE INVENTION

It is an object of the invention to provide an NC vertical spindle jig grinder which ensures form trueing of spherical abrasive tools.

Another object of the invention is to provide an NC vertical spindle jig grinder which helps obtain a required position of the generant of a spherical abrasive tool or its part contacting the workpiece surface to optimize the cutting capacity of the tool.

One of the objects of the invention is to provide an NC vertical spindle jig grinder which renders it possible to match the curvature of a spherical abrasive tool with a local curvature of the workpiece surface so as to improve the tool efficiency and ensure more effective use of the grinding tool.

The invention resides in that in an NC vertical spindle jig grinder comprising a bed having a column which is rigidly held thereto and has vertically extending guides, a compound table traversable along X and Y axes and carrying the workpiece, a wheel dresser, and an NC system electrically connected to movable assemblies of the grinder, according to the invention, a slide is traversable upon the vertical ways of the column along the Z axis, the slide having circular ways and a lay-shaft, a cradle being installed on the circular ways with a possibility of traversing along a circular coordinate axis B with respect to the axis of the lay-shaft, the cradle carrying a turret indexable about its horizontal axis together with at least two wheelheads whose longitudinal axes are square with the horizontal axis of the turret, each of the wheel-head being provided with a wheel spindle with an axis thereof making up a preset angle $\alpha$ with the wheel-head axis, spindle being rotatable about the longitudinal axis of the wheelhead and carrying a spherical abrasive tool of an arbitrary diameter, a geometrical center of the spherical abrasive tool lying on the geometrical axis of rotation of the cradle, while the wheel dresser is located on the compound table at a point which is situated on the line of intersection of a vertical plane passing through the lay-shaft axis with the horizontal surface of the compound table, when the spherical abrasive tool is being form-trued and dressed.

In order to reduce the effect of load of various assemblies of the grinder on its accuracy, the cradle preferably carries two rows of taper rollers interposed between the end faces of the circular slide ways, the rollers being in contact with the end face of the circular slide ways along the generants square with lay-shaft axis.

The invention renders it possible to automate machining of dies, blades, propellers, templets and similar workpieces having intricate three-dimensional configuration of surfaces in the mechanical engineering, and thus to dispense with a large number of gauge makers working under harmful conditions of abrasive dust and using portable grinders that cannot ensure the desired accuracy of machining.

BRIEF DESCRIPTION OF THE ACCOMPANYING DRAWINGS

The invention will now be described with reference to specific embodiments illustrated in the accompanying drawings, in which.

Figure 1:
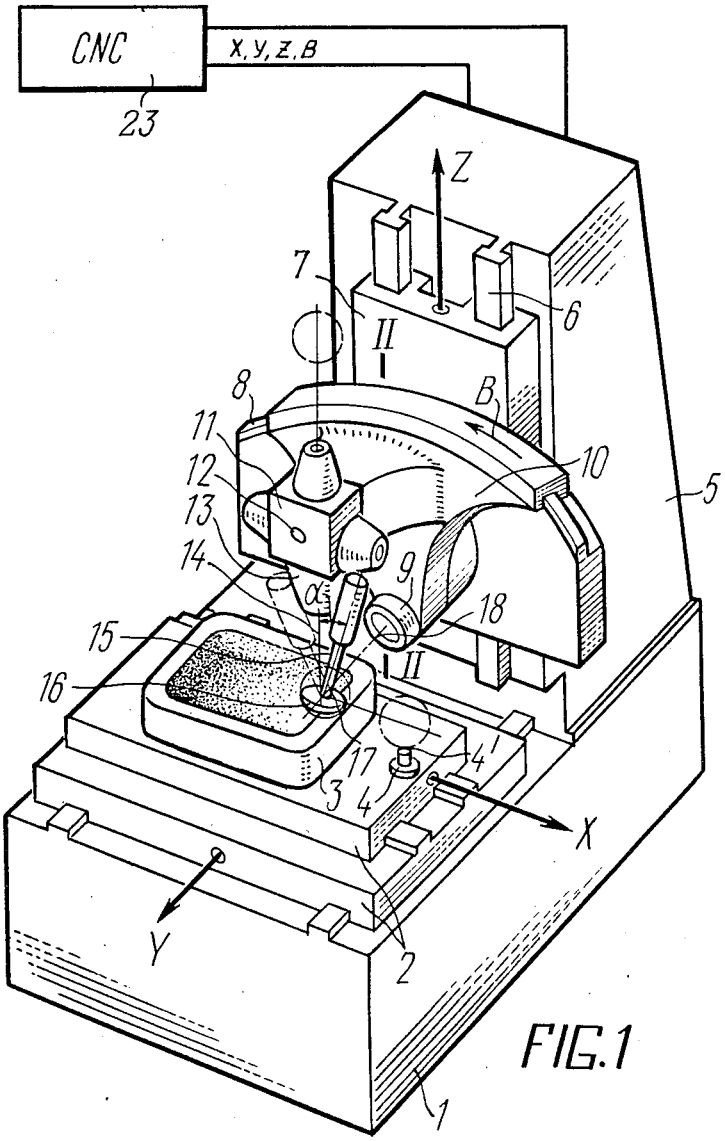
FIG. 1 shows a schematic structural view of a vertical spindle jig grinder according to the invention.

An NC vertical spindle jig grinder comprises a bed I (FIG. I) with a compound table 2 traversable along the X and Y axes and carrying the workpiece 3 and a wheel dresser 4 with a diamond grinding tool 4' and a column 5 having vertical ways 6. A slide is traversable along the Z axis on the vertical ways 6 of the column 5 and comprises circular ways 8 and a lay-shaft 9. Installed on the circular ways 8 with a possibility of traversing along a circular coordinate axis B with respect to the axis of the lay-shaft 9 is a cradle 10, which carries a turret II indexable about its horizontal axis 12 together with at least two wheelheads 13, the longitudinal axes 14 of the wheelheads, being square with the horizontal axis 12 of the turret II. Each of the wheelhead 13 is provided with a wheel spindle 15, its axis making up a preset angle $\alpha$ with the axis 14 of the wheelhead 13, the spindle being rotatable about the axis 14 of the wheelhead 13 and carrying a spherical abrasive tool 16 of an arbitrary diameter whose geometrical center 17 of rotation lies on a geometrical axis 18 of rotation of the cradle 10. The geometrical axis 18 of rotation of the cradle 10 is the axis of the lay-shaft 9.

The wheel dresser 4 is located on the compound table 2 and the apex of the diamond grinding tool 4' of the wheel dresser 4 is situated in a vertical plane passing through the axis 18 of the lay-shaft 9 when the spherical abrasive tool is being form-trued and dressed.

The cradle 10 has arms 19 carrying two rows of taper rollers 20 in such a manner that generants 21 of the rollers 20 contacting the end faces of the circular guides 8 are square with the axis 18 of the lay-shaft 9.

The cradle 10 with the shaft 9 is journalled in the slide 7 by means of bearings 22.

The numerical control of the grinder may be effected by any appropriate known CNC system which solves problems arising in machining three-dimensional surfaces such as the Fanuc System 6M- Model F (cf. FANUC (Japan), N6MF-0.1, 1984.3). If necessary, the software package FART-DiE. I1 may also be used (cf. FANUC, PE-02, 1983, II) for making choice of machining flowchart and strategy, corrections taking into account wear of spherical abrasive tools upon dressing and recalculation of three-dimensional equidistant surfaces.

The NC vertical spindle jig grinder according to the invention functions in the following manner.

For machining the workpiece 3 (FIG. 1), the table 2, slide 7 and cradle 10 are traversed along axes X, Y, Z, B, respectively, following instructions received from the NC system 23.

The spherical abrasive tool 16 is profiled as a sphere or parts thereof by the wheel dresser 4 provided, e.g. with the diamond grinding tool 4' during rotation of the cradle 10 and spindle 15.

Depending on a specific three-dimensional configuration of the workpiece and curvature of its individual portions, the abrasive tools 16 having different diameters of the spherical surfaces are brought in contact with the workpiece 3. For that purpose, the turret 11 is indexed in a known per se manner and is stopped. For achieving the desired contact between the spherical abrasive tool 16 and the workpiece 3, and to ensure more convenient access to individual portions of the intricately shaped surface of the workpiece 3, each of the spindles 15 can take various positions in space when it is rotated about the axis 14 of the wheelhead 13.

Therefore, a required positioning of a generant of the spherical abrasive tool 16 (or a part thereof) which is in contact with the workpiece is ensured so as to optimize the cutting capacity of the tool.

Machining of the workpiece 3 is performed by the line-by-line method during the continuous movement of the grinder assemblies along axes X,Y and B. In this case, the Z coordinate is used for the line-by-line feed. Other combinations of movement of the grinder assemblies are also possible where the Y coordinate may be used for the line-by-line feed.

Each of the tools 16 is fed for dressing toward the wheel dresser 4 by traversing the slide 7 along the Z axis.

When it is necessary to dress a straight profile of the spherical abrasive tool, the cradle 10 is rotated through the angle $\alpha$ in the direction away from the spindle 15 so that the axis of the spindle is set vertically. The grinding wheel is dressed by traversing the slide 7 relative to the wheel dresser 4 which has additional horizontally arranged diamond grinding tool (not shown in the drawings).

Intermediate positions of the axis of the spindle 15 enable the spherical abrasive tool 16 to be profiled as cones and hyperboloids.

The vertical arrangement of the grinder and functions of its basic assemblies call for the heavy cradle carrying the turret 11 to be installed without any free play relative to the slide 7. At the same time, the cradle 10 should traverse relative to the slide 7 without the sliding contact friction.

Figure 2:
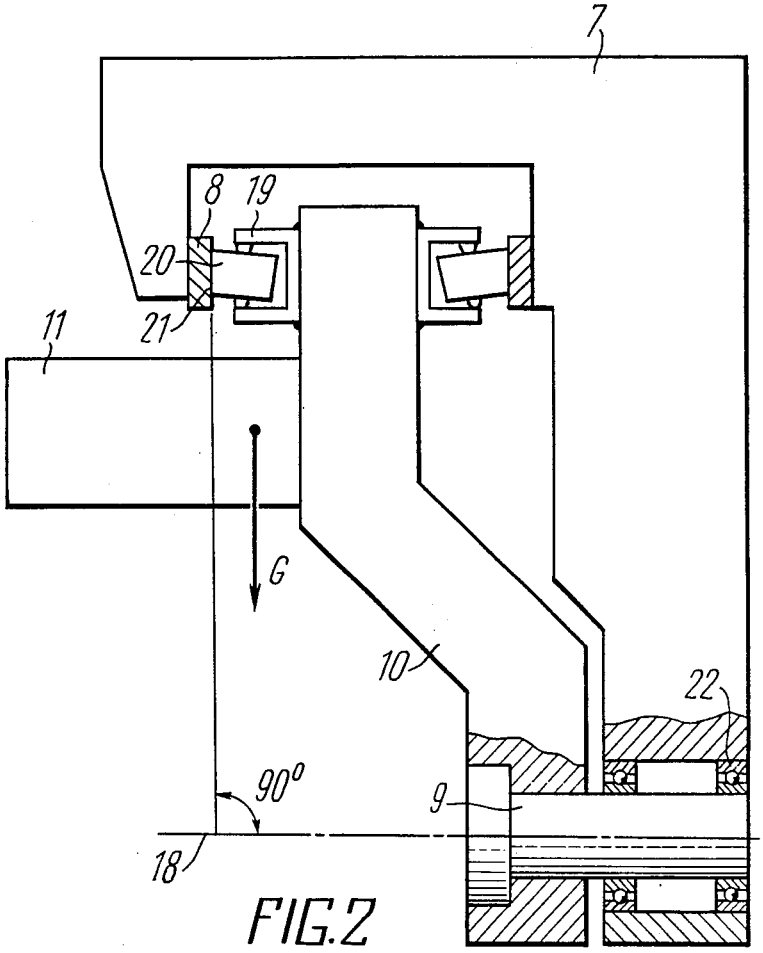
FIG. 2 is a sectional view taken along line II—II in FIG. 1.

For that purpose, the cradle 10 with its shaft 9 may be journalled in the slide 7, e.g. by means of the rolling contact bearings 22 (FIG. 2), and the bending moment caused by weight G of the cradle 10 and turret 11 is taken-up by the two rows of taper rollers 20 which contact the end faces of the circular guides 8 and slide 7 without any clearance.

Depending on a specific three-dimensional configuration of the workpiece and curvature of its individual portions, the abrasive tools 16 of different diameter of the spherical surface are brought in contact with the workpiece. Matching the curvature of the spherical abrasive tool with a local curvature of the workpiece makes it possible to use each spherical abrasive tool 16 in the most effective manner.

Therefore, the NC vertical spindle jig grinder renders it possible to machine three-dimensional surfaces of workpieces, including, those having alternating curvature, and improves the tool machining efficiency.

What we claim is:

1. A numerically controlled substantially upright spindle jig grinder arrangement, comprising a bed;

a compound table carrying a workpiece traversable on said bed in a substantially horizontal plane along at least two axes independent from each other;

a column rigidly attached to the bed, said column having at least one first guide means positioned in a substantially upright direction;

slide means movable along said first guide means in the direction of a third axis;

said slide means having at least one second guide means having arc-shaped configuration;

said slide means having a lay-shaft;

base means movable on said second guide means relative to an axis of said lay-shaft along an arc shaped coordinate axis;

receiving means positioned on said base means indexable about an axis of said receiving means;

said receiving means having at least two wheelheads, longitudinal axes of said wheelheads laying in planes substantially perpendicular to the plane of the axis of said receiving means a wheel spindle of each said wheelheads has an axis interposed at a predetermined angle to the axis of the wheelhead; said wheel spindle rotating during machining of the workpiece about the longitudinal axis of said wheelhead;

a spherical abrasive tool positioned on said wheel spindle; a geometrical center of said spherical abrasive tool lying on the geometrical axis of rotation of said base means; the grinding allowance being removed from the workpiece when the spherical abrasive tool rotates about the axis of said wheel spindle;

a wheel dresser located on said compound table; said wheel dresser traversing together with said compound table relative to said base means to a position at which said wheel dresser is situated on the line of intersection of a vertical plane passing through the lay-shaft axis with the horizontal surface of said compound table when the spherical abrasive tool is being formed and dressed;

forming and dressing of the surface of the spherical abrasive tool occur when said slide means traverses rotation of said spherical abrasive tool and oscillations of said base means moves through a preset angle depending on the shape and dimensions of a spherical layer of the abrasive tool; and numerically controlled system electrically connected to said jig grinder arrangement.

2. An arrangement according to claim 1 wherein said two axes of traversing of the compound table are substantially perpendicularly to each other.

3. An arrangement according to claim 1 wherein the axis of the receiving means lays in a substantially horizontal plane.

4. An arrangement according to claim 1 further comprising at least two rows of taper rollers;

said two rows of taper rollers interposed between end faces of said second guide means having arc-shaped configuration and are in contact with end faces of said arc-shaped slide means along the generants square with the lay-shaft axis.

* * * * *